US006799762B2

(12) United States Patent
Bernardi, II

(10) Patent No.: US 6,799,762 B2
(45) Date of Patent: Oct. 5, 2004

(54) PSYCHIC SEEDS ENTERTAINING GROWTH SYSTEM

(76) Inventor: Richard Bruce Bernardi, II, 7720 156th St. SE., Snohomish, WA (US) 98296

( * ) Notice: Subject to any disclaimer, the term of this patent is extended or adjusted under 35 U.S.C. 154(b) by 0 days.

(21) Appl. No.: 10/248,359

(22) Filed: Jan. 14, 2003

(65) Prior Publication Data

US 2004/0135313 A1 Jul. 15, 2004

(51) Int. Cl.[7] ..... A63F 9/18
(52) U.S. Cl. ..... 273/161; 206/423; 47/66.7
(58) Field of Search ..... 273/161, 138.1; 446/385, 372, 259; 229/403, 404; 206/423; 47/65, 65.6, 66.6, 66.7

(56) References Cited

U.S. PATENT DOCUMENTS 3,510,964 A * 5/1970 Dahners et al. ..... 434/98
3,974,916 A * 8/1976 Bartolucci ..... 206/459.1
4,118,889 A * 10/1978 Lamlee ..... 47/14

OTHER PUBLICATIONS http://www.sherrysgreenhouse.com/GHtomnotes.html, pp. 1–4, May 2001.*

* cited by examiner

*Primary Examiner*—William M. Pierce

(57) ABSTRACT

An Entertaining Growth System that utilizes the growth of a seedling within its design to create an entertaining and interesting device of chance. In its simplest form it allows the user to ask a "question" of the Entertaining Growth System and receive an "Answer" by observing the Dynamic Growth of a plant, in this case as seedling, through labeled holes in a lid.

18 Claims, 3 Drawing Sheets

PSYCHIC SEEDS ENTERTAINING GROWTH SYSTEM

BACKGROUND OF INVENTION

Since the beginning of recorded history, mankind has had a universal desire to predict his future and receive guidance from unseen forces. This inate tendancy has led to the development of various entertainment technologies that address this need.

Some of these constructs are comprised of complex belief systems while others are comprised of light-hearted devices of chance such as Dice or Tarot Cards The present invention was inspired by such light-hearted devices of chance.

SUMMARY OF INVENTION

This present invention relates to an Entertaining Growth System that entertains individuals by allowing the randomness of plant growth to be utilized within this device of chance. The key to this Entertaining Growth System is a specially designed lid otherwise known henceforth as a Lid Indica.

In a simple embodiment of the present invention there is a small pot, potting soil, some water, a seed and a lid for the pot. The lid fits over the pot comfortably and has two holes large enough for a seedling to grow through. These holes are labeled "Yes" and "No".

The user plants the seed in the pot and at some point before the seedling emerges the user asks the seed a question; in a simple case, a "Yes/No" question. When the seedling emerges from the soil, because of phototropism it then must go through one of the holes in the Lid Indica. The user's question is finally answered by the label of the hole through which the seedling emerges.

BRIEF DESCRIPTION OF DRAWINGS

Further objects, features and advantages of the present invention will become apparent upon the consideration of the presented embodiments when taken in conjunction with the accompanying drawings, wherein.

DETAILED DESCRIPTION

The present invention will be described and referenced to the included drawings. It will be apparent that the present invention has broader application and can be employed in different forms as a device of chance for entertainment purposes.

Figure 1:
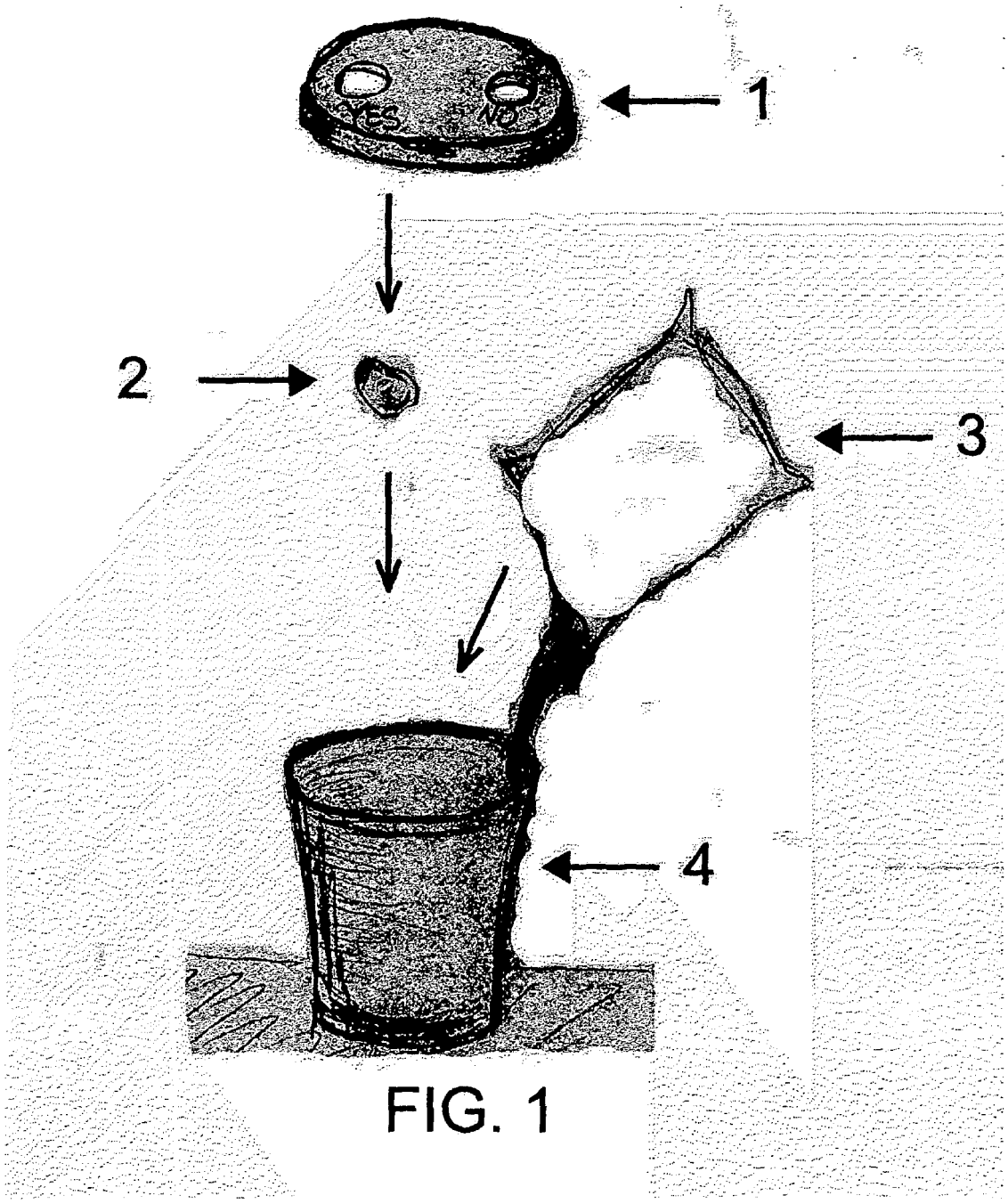
FIG. 1 is a simple embodiment of the present invention showing the Dynamic Growth System in an exploded view.

Referring to FIG. 1, a seed 2 is planted in soil 3 which has been added to a pot 4. After water is added, a Lid Indica 1 is placed over the pot and the seed is allowed to grow.

Figure 2:
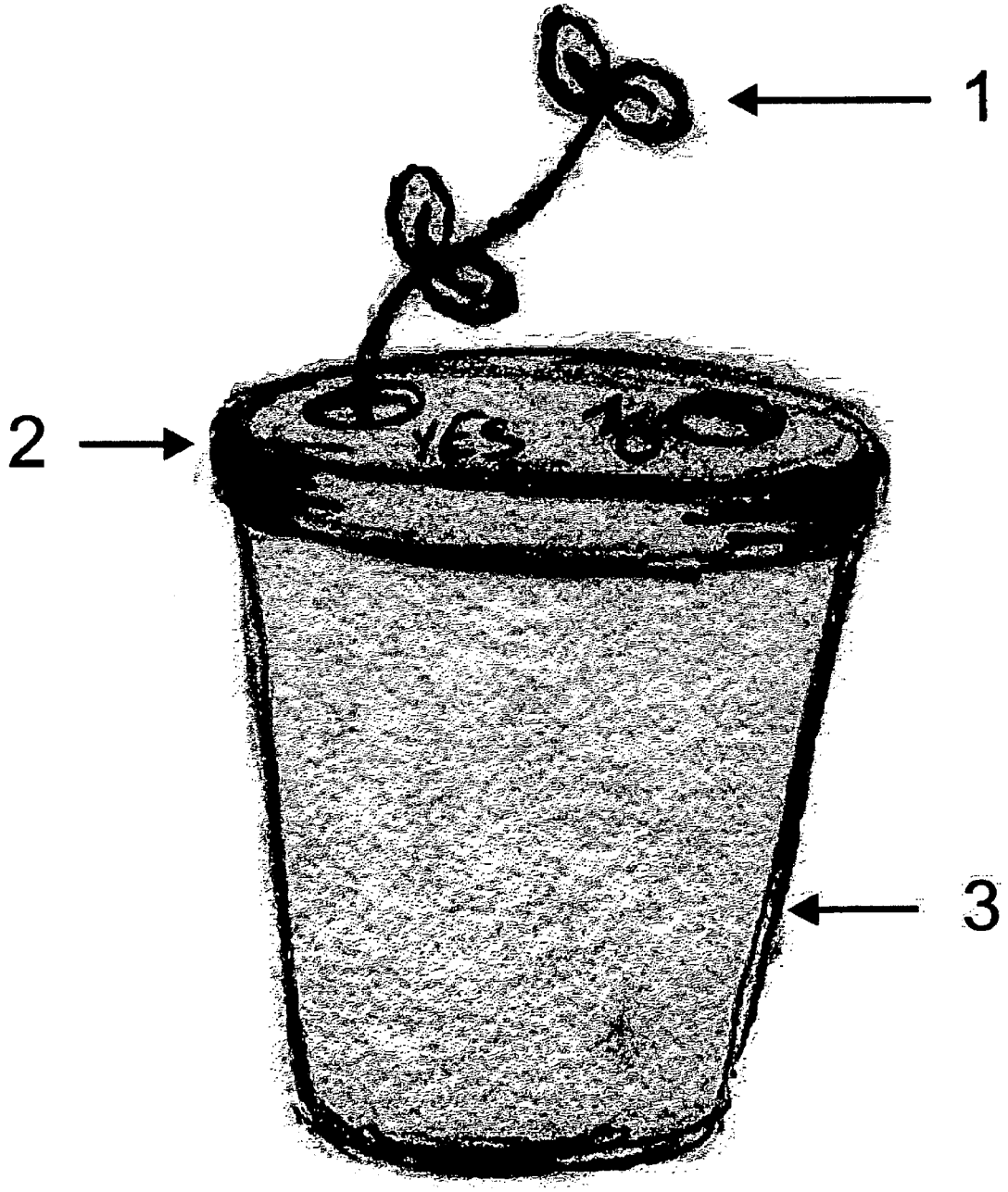
FIG. 2 is the simple embodiment of the present invention with seedling emerged.

Referring to FIG. 2, after an adequate amount of time a seedling 1 emerges through a hole in the lid indica 2 which is resting on the pot 3. In FIG. 2, the seedling 1 has emerged from a hole labeled "yes", therefore the present invention is indicating "yes". The system can be reused, however, a new seed would be needed. In which case a new indication would result.

Figure 3:
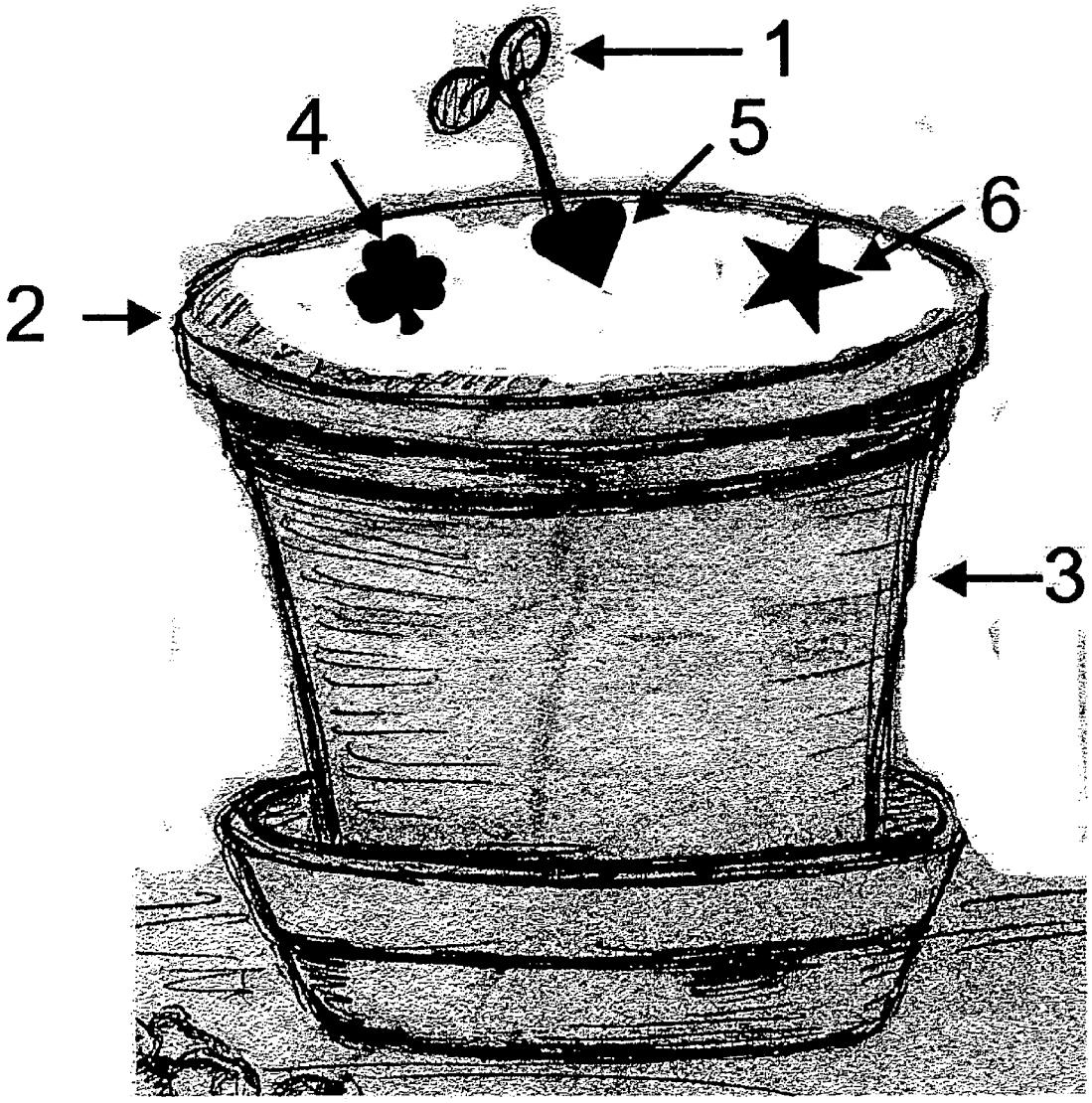
FIG. 3 is another embodiment of the present invention with specially shaped holes in the lid indica with a seedling emerged.

Referring to FIG. 3, a seedling 1 has emerged from an heart-shaped hole 5 in the lid indica 2 which is resting on a pot 3. The seedling emerging from the heart-shaped hole 5 might indicate love is in the future, where-as its emergence from the star-shaped hole 6 might indicate fame is in the future and perhaps the clover shaped hole 4 might indicate luck.

As indicated above, the present invention is a simple but novel combination of technologies present in the public domain and can be manufactured as such. Reference FIG. 1 The lid indica 1 and pot 4 of the present invention can easily be manufactured, by those skilled in the art, out of a variety of materials such as pottery, plastic or metal to name a few. In addition, reference FIG. 1, there are several soil or growth matrix 3 choices available in the market, known to those skilled in the art, potting soil and peat pellets to name a few. Lastly, reference FIG. 1, a variety of commonly available seed(s) 2 are available and are known to those skilled in the art such as Hyacinth Bean and Scarlet runner bean to name only two. These varieties have the added attribute of being fast germinators.

In accordance with the present invention, entertainment is the objective. The users active participation in the planting and germination of the seed as well as the observance of the seedlings emergence or resultant emergence will, thereby, impart a level of enjoyment ultimately entertaining the user.

Using the embodiment of the invention indicated in FIG. 1, a first typical, but not limiting, user scenario can be as follows:

A user is interested in whether or not to learn the piano. The user then takes the present invention and plants the seed 2 in the soil 3 in the pot 4 adds some water and places the lid indica 1 on the pot 4. The user then awaits the seedlings emergence through the lid indica all the while contemplating their question, "Should I learn the Piano", and being entertained. When finally, the seedling emerges through the "Yes" hole in the lid indica, reference FIG. 2, at which point the present invention indicates that the user should indeed learn the piano.

Using the embodiment of the invention indicated in FIG. 3, a second typical, but not limiting, user scenario can be as follows:

A user is interested in what the future holds for next year. As in the previous example the user plants the seed but in this case the lid indica is of a variety indicated in FIG. 3, where the Clover hole indicates luck, the Heart hole indicates love and the Star hole indicates fame. In this scenario, the user awaits the seedling's emergence which is through the heart-shaped hole indicating that they should expect Love in the next year.

Although the embodiments of FIG. 1 & FIG. 3 include the seed, the pot, the soil and the lid indica in the rendering, after the illustration of the present invention's use, it is clear that the lid indica is the key to this invention's novelty and could thereby be used with pots and seeds that the user has acquired independent of this invention. For example, a user has a favorite pot that they like to start tomato plants in, they could use the lid indica with their favorite pot and tomato seeds in one of the manners discussed in the scenarios mentioned earlier. Furthermore, a pot may not be necessary if the lid indicia where to be placed over a planted seed in a garden for example.

Although illustrated and described above with reference to a certain specific embodiment, the present invention is nevertheless not intended to be limited to the details shown. Rather, various modifications may be made in the details within the scope and range of equivalents of the claims and without from the spirit of the invention.

What is claimed is:

1. An apparatus for indicating a determinate from an array of possible determini comprising:

(a) a pot of predetermined size holding (b) soil containing (c) a seed (d) a lid indica with a plurality of holes with predetermined diameters allowing said seed to grow through whereby each said hole has an associated label (e) means far joining said lid indica to said pot at a predetermined height over said soil whereby said holes in said lid indica are oriented to said seed so as to allow said seed to grow through said holes.

2. The apparatus of claim 1 wherein said label is a word.

3. The apparatus of claim 1 wherein said label is a symbol.

4. The apparatus of claim 1 wherein said label is a picture.

5. The apparatus of claim 1 wherein said label is the unique shape of each said hole.

6. The apparatus of claim 1 wherein said lid indicia allows seedling to grow randomly through one of said holes.

7. The apparatus of claim 1 wherein said lid indicia allows seedling to grow randomly under the influence of light through one of said holes.

8. An apparatus for indicating a determinate from an array of possible determini comprising:

(a) a container of predetermined size holding (b) a growth matrix containing (c) a propogative part of a plant (d) a lid indica with a plurality of holes with predetermined diameters allowing said propagative part of a plant to grow through under the influence of light whereby each said hole has an associated label (e) means for joining said lid indica to said container at a predetermined height over said growth matrix whereby said holes in said lid indica are oriented to said propogative part of a plant so as to allow said propogative part of a plan to grow under the influence of light through said holes.

9. The apparatus of claim 8 wherein said label is a word.

10. The apparatus of claim 8 wherein said label is a symbol.

11. The apparatus of claim 8 wherein said label is a picture.

12. The apparatus of claim 8 wherein said label is the unique shape of each said hole.

13. The apparatus of claim 8 wherein said lid indicia allows said propogative pelt of a plant t grow randomly under the influence flight through one of said holes.

14. An apparatus for indicating a determinate from an array of possible determini comprising:

(a) a container of predetermined size holding (b) a growth matrix containing (c) a propogative part of a plant (d) a lid indica with a plurality of holes with predetermined diameters allowing said propogative part of a plant to grow through under the influence of light whereby each said hole has an associated label (e) means for joining said lid indica to said container at a predetermined height over said growth matrix whereby said holes in said lid indicia are oriented to allow said propagative part of a plant to grow randomly under the influence of light through one of said holes.

15. The apparatus of claim 14 wherein said label is a word.

16. The apparatus of claim 14 wherein said label is a symbol.

17. The apparatus of claim 14 wherein said label is a picture.

18. The apparatus of claim 14 wherein said label is the unique shape of each said hole.

* * * * *